US008029319B2

(12) United States Patent
Kameyama et al.

(10) Patent No.: US 8,029,319 B2
(45) Date of Patent: Oct. 4, 2011

(54) SHIELDED CONNECTOR STRUCTURE

(75) Inventors: Isao Kameyama, Makinohara (JP); Motoo Nojima, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/175,019

(22) Filed: Jul. 17, 2008

(65) Prior Publication Data

US 2009/0023339 A1 Jan. 22, 2009

(30) Foreign Application Priority Data

Jul. 18, 2007 (JP) ..... 2007-186758

(51) Int. Cl.
*H01R 13/649* (2006.01)

(52) U.S. Cl. ..... 439/607.01

(58) Field of Classification Search ..... 439/607.01, 439/607.56, 607.41, 63, 931, 557
See application file for complete search history.

(56) References Cited

U.S. PATENT DOCUMENTS

| | | | | |
|---|---|---|---|---|
| 4,883,433 | A * | 11/1989 | Lane | 439/607.01 |
| 5,035,652 | A | 7/1991 | Shibano et al. | |
| 6,666,719 | B1 * | 12/2003 | Kuroi et al. | 439/607.19 |
| 6,695,636 | B2 * | 2/2004 | Hall et al. | 439/352 |
| 7,052,320 | B2 * | 5/2006 | Zhang et al. | 439/607.36 |
| 7,070,424 | B2 * | 7/2006 | Obikane et al. | 439/74 |
| 7,077,696 | B2 * | 7/2006 | Haga et al. | 439/553 |
| 7,104,842 | B1 | 9/2006 | Huang et al. | |
| 7,150,648 | B1 * | 12/2006 | Hall et al. | 439/581 |
| 7,219,404 | B2 * | 5/2007 | Haga et al. | 24/458 |
| 2002/0106914 | A1 | 8/2002 | Belanger et al. | |
| 2002/0142658 | A1 | 10/2002 | Koide et al. | |
| 2003/0129864 | A1 | 7/2003 | Peloza et al. | |
| 2005/0044675 | A1 * | 3/2005 | Haga et al. | 24/459 |
| 2005/0221673 | A1 | 10/2005 | Myer et al. | |
| 2006/0079112 | A1 | 4/2006 | Shuey et al. | |

FOREIGN PATENT DOCUMENTS

| | | | |
|---|---|---|---|
| DE | 4015915 | A1 | 11/1990 |
| EP | 1460732 | A2 | 9/2004 |
| JP | 2006-310164 | A | 11/2006 |

OTHER PUBLICATIONS

European Search Report issued in European Application No. 08160764.0-2214/202643 dated Jul. 7, 2010 (8 pages).
Extended European Search Report issued on May 16, 2011 in the corresponding European Patent Application No. 11156881.2.

* cited by examiner

*Primary Examiner* — Alexander Gilman
(74) *Attorney, Agent, or Firm* — Sughrue Mion, PLLC

(57) ABSTRACT

A shielded connector structure includes a first connector and a second connector, each having a metal terminal element, an insulating connector housing that has a terminal container for accommodating the metal terminal elements, and a conductive shield shell which covers the terminal container of the connector housing. The shielded connector structure further includes a conductive connector mounting portion which contacts the shield shell of at least one of the first and second connectors to ground the shield shell; and a connecting portion which is provided on each of the shield shells of the first and second connectors, and is coupled to the connector mounting portion when the first and second connectors are engaged to shield-connect the shield shells each other.

11 Claims, 10 Drawing Sheets

SHIELDED CONNECTOR STRUCTURE

BACKGROUND OF THE INVENTION

1. Technical Field

The present invention relates to a shielded connector structure which includes a pair of connectors each having a conductive shield shell covering a connector housing which accommodates a metal terminal element, and a conductive connector mounting portion, and in which a shield shell that is grounded at the connector mounting portion to discharge a noise.

2. Background Art

Various electronic apparatuses are mounted in a mobile vehicular body configured as an automobile. Therefore, wire harnesses are prepared and installed in order to supply electric power and signals to the electronic apparatuses on the automobile. These wire harnesses includes multiple electric wires and connectors attached to the wires.

A three-phase electric motor may be employed as a driving motor in the above-mentioned automobile such as an electric car, a hybrid car and a fuel-cell vehicle. Since high voltages are normally supplied for this type of motor, there are problems that external leakage of electrical noise originating at a metal terminal element provided on a power supply terminal occurs, or that such noise flows from one such terminal metal element to another.

As a technique for resolving this problem, use of a shielded connector (see, for example, patent document 1) has been proposed. The shielded connector includes: an insulated connector housing which is formed of a terminal container that contains a metal terminal element and an outer housing that is located outside the terminal container; a conductive inner shield shell which covers the terminal container; and a conductive outer shield shell which is formed separately from the inner shield shell and covers the outer housing while contacting the inner shield shell. One end of the inner shield shell and one end of the outer shield shell are grounded.

A mating shielded connector which is to engage the shielded connector is formed, for example, of: an insulating connector housing which includes a terminal container that accommodates a metal terminal element, and a conductive shield shell that covers another connector housing. Then, when the two shielded connectors are engaged, the conductive shield shell and the inner shield shell are connected electrically. Thus, electrical noise originating at the terminal fitting, which could be leaked externally or could enter the shield shell interior, is altered to provide a return current that flows from the shield shell of the second shielded connector to the inner shield shell of the shielded connector. Thereafter, the return current is either discharged from the inner shield shell, or flows from the inner shield shell to the outer shield shell and to be finally discharged.

[Patent Document 1] JP-A-2006-310164

As described above, since part of the electrical noise is flowed from the shield shell of the mating shielded connector to the inner shield shell of the shielded connector and to the outer shield shell and is discharged externally, the path from the shield shell to the outer shell is extended. Accordingly, because of electric resistance along the path, the free flow of the return current is impeded and the electrical noise can not be appropriately discharged.

SUMMARY OF THE INVENTION

The object of the present invention is to resolve this problem. Specifically, the object of this invention is to provide a shielded connector structure that effectively releases noise by shortening a path for the flow of a return current, and that thus exhibits a satisfactory shielding property.

To achieve this object, according to the invention, there is provided a shielded connector structure, including:

a first connector and a second connector, each including:

a metal terminal element;

an insulating connector housing that has a terminal container for accommodating the metal terminal elements; and a conductive shield shell which covers the terminal container of the connector housing;

a conductive connector mounting portion which contacts the shield shell of at least one of the first and second connectors to ground the shield shell; and a connecting portion which is provided on each of the shield shells of the first and second connectors, and is coupled to the connector mounting portion when the first and second connectors are engaged to shield-connect the shield shells each other.

Preferably, at least one of the connecting portions is projected toward the connector mounting portion, so that when the first and second connectors are engaged each other, the connecting portion is elastically deformed while contacting the connector mounting portion to generate an elastic restoring force for pressing the connector mounting portion.

According to another aspect of the invention, there is provided a shielded connector structure, including:

a first connector and a second connector, each including:

a metal terminal element;

an insulating connector housing that has a terminal container for accommodating the metal terminal elements; and a conductive shield shell which covers the terminal container of the connector housing; and a conductive connector mounting portion which contacts the shield shell of the first connector to ground the shield shell, wherein the connector housing of the first connector includes an outer housing provided outside the terminal container of the first connector;

wherein the shield shell of the first connector includes an inner shield shell which covers the terminal container of the first connector, and an outer shield shell which contacts the inner shield shell and covers the outer housing; and wherein a connecting portion is provided on one of the outer shield shell of the first connector and the shield shell of the second connector to couple to the other of the outer shield shell of the first connector and the shield shell of the second connector.

Preferably, the connecting portion is projected from one of the outer shield shell of the first connector and the shield shell of the second connector to the other, so that when the first and second connectors are engaged each other, the connecting portion is elastically deformed while contacting the other to generate an elastic restoring force for pressing the other.

Here, it is preferable that a first through hole is formed through the outer housing of the first connector so that the connecting portion is inserted into the first through hole.

Here, it is preferable that the connector housing of the second connector includes an outer housing provided outside the terminal container of the second connector; and a second through hole is formed through the outer housing of the second connector so that the connecting portion is inserted into the second through hole.

According to the above configuration, the connecting portions are respectively provided on the shield shells of the connectors, so that when the connectors are engaged and the shield shells are shield-connected, the connecting portions are connected to the connector mounting portion. Therefore, noise blocked by the shield shells is flowed, as a return current, directly to the connector mounting portion, and is discharged externally.

According to the above configuration, at least one connecting portion is projected toward the connector mounting portion, and when the connectors are engaged, the connecting portion is elastically deformed while contacting the connector mounting portion to generate a elastic restoring force for pushing the connector mounting portion. Therefore, the connecting portions are properly connected to the connector mounting portion.

According to the above configuration, the connecting portion is provided on either the outer shield shell of one connector or the shield shell of the other connector, and is to be connected to the other connector. Therefore, noise blocked by the shield shell of the other connector is flowed, as a return current, through the outer shield shell of the connector to the connector mounting portion, and is externally discharged.

According to the above configuration, the connecting portion is projected from one of the outer shield shell and the shield shell of the other connector toward the other, and when the two connectors are engaged, the connecting portion is elastically deformed while contacting the other connector to generate a elastic restoring force for pushing the other connector. Therefore, the connecting portion and the other shield shell (or the shield shell of the other connector) can be properly connected.

According to the above configuration, a first through hole is formed through the outer housing of one connector so that the connecting portion is inserted into the first through hole. Thus, the connecting portion is connected to the outer shield shell of one connector (or the shield shell of the other connector) by being passed through the first through hole.

According to the above configuration, the connector housing of the other connector includes the terminal container, the outer housing located outside the terminal container, and a second through hole which is formed through the outer housing so that the connecting portion is inserted into the second through hole. Therefore, the connecting portion is connected to the outer shield shell of one connector (or the shield shell of the other connector) by being passed through the second through hole.

According to the above configuration, the connecting portions are respectively provided on the shield shells of the connectors so that when the connectors are engaged and the shield shells are shield-connected to each other, the connecting portions are connected to the connector mounting portion. Therefore, noise blocked by the shield shells is flowed as a return current, directly to the connector mounting portion, and is discharged externally. Thus, since the length of a path along which a return current flows can be reduced and noise can be effectively discharged, a satisfactory shielding property is obtained.

According to the above configuration, at least one connecting portion is projected toward the connector mounting portion, and when the connectors are engaged, the connecting portion is elastically deformed while contacting the connector mounting portion to generate a elastic restoring force for pushing the connector mounting portion. Therefore, the connecting portions are properly connected to the connector mounting portion, and noise can be appropriately discharged and a satisfactory shielding property obtained.

According to the above configuration, the connecting portion is provided on either the outer shield shell of one connector or the shield shell of the other connector, and is to be connected to the other connector. Therefore, noise blocked by the shield shell of the other connector is flowed, as a return current, through the outer shield shell of the connector to the connector mounting portion, and is externally discharged. Therefore, since the length of a path along which the return current flows can be reduced and noise can be effectively discharged, a satisfactory shielding property is obtained.

According to the above configuration, the second connecting portion is projected from one of the outer shield shell and the shield shell of the other connector toward the other, and when the two connectors are engaged, the connecting portion is elastically deformed while contacting the other connector to generate a elastic restoring force for pushing the other connector. Therefore, the second connecting portion and the other shield shell (or the shield shell of the other connector) can be properly connected, and noise can be appropriately discharged and a satisfactory shielding property obtained.

According to the above configuration, a through hole is formed through the outer housing of one connector. Thus, the second connecting portion is connected to the outer shield shell of one connector (or the shield shell of the other connector) by being passed through the through hole, and the connecting portion and the outer shield shell (or the shield shell of the other connector) can be properly connected.

According to the above configuration, a second through hole is formed through the outer housing of the other connector so that the connecting portion is inserted into the second through hole. Therefore, the connecting portion is connected to the outer shield shell of one connector (or the shield shell of the other connector) by being passed through the second through hole. Thus, the second connecting portion and the outer shield shell (or the shield shell of the other connector) can be properly connected.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

First Embodiment

Figure 1:
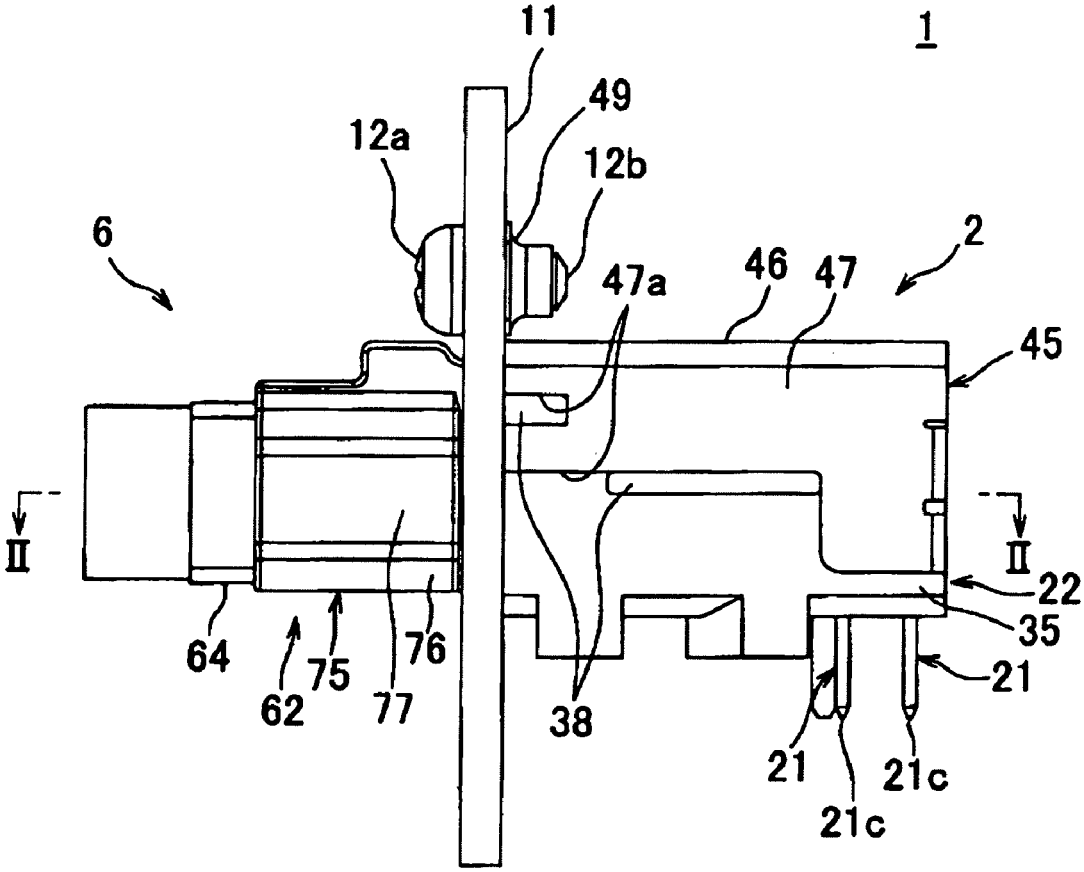
FIG. 1 is a side view of a shielded connector structure according to a first embodiment of the present invention.

A shielded connector structure 1 according to a first embodiment of the present invention will now be described while referring to FIGS. 1 to 7. As shown, for example, in FIG. 1, the shielded connector structure 1 of the first embodiment includes: a pair of connectors 2 and 6 that engage each other and that include shield shells 23 (FIG. 7) and 63 (FIG. 5), respectively; and a conductive connector mounting portion 11 which contacts the shield shell of at least one of the connectors, e.g., the shield shell 23 of the first connector 2, to ground the shield shell 23. When the connectors 2 and 6 are engaged, the shield shells 23 and 63 are shield-connected.

The term, "shield-connected" is used to describe an operating state existing when the shield shells 23 and 63 are connected and circumferentially enclose metal terminal elements 21 and 61 which will be described later. When the shield shells 23 and 63 are shield-connected, electrical noise that leaks externally or enters the shield shells 23 and 63, can be surely blocked by the shield shells 23 and 63.

Figure 2:
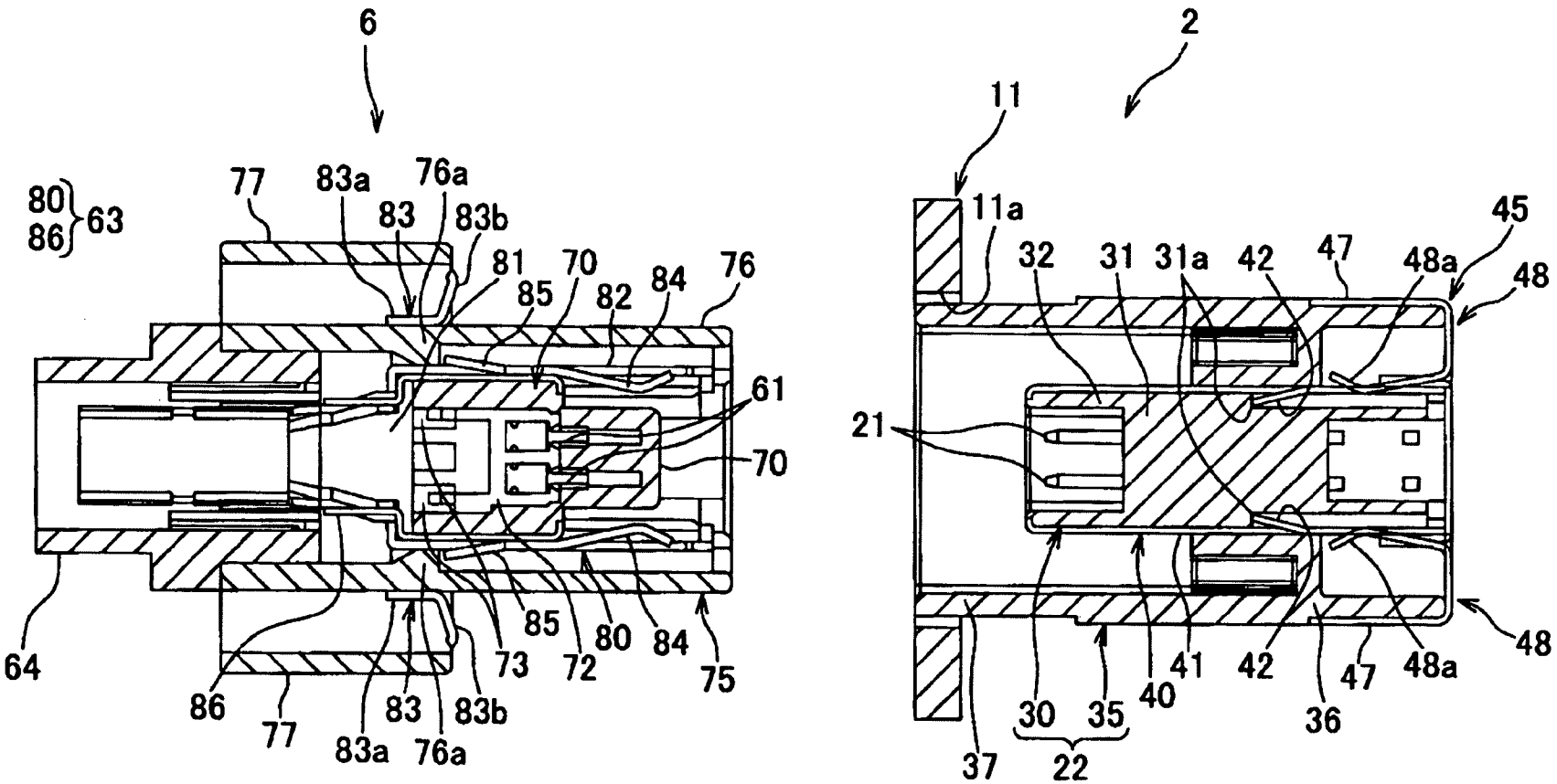
FIG. 2 is a cross-sectional view, taken along the line II-II in FIG. 1, of the state before a pair of connectors shown in FIG. 1 are engaged.
Figure 3:
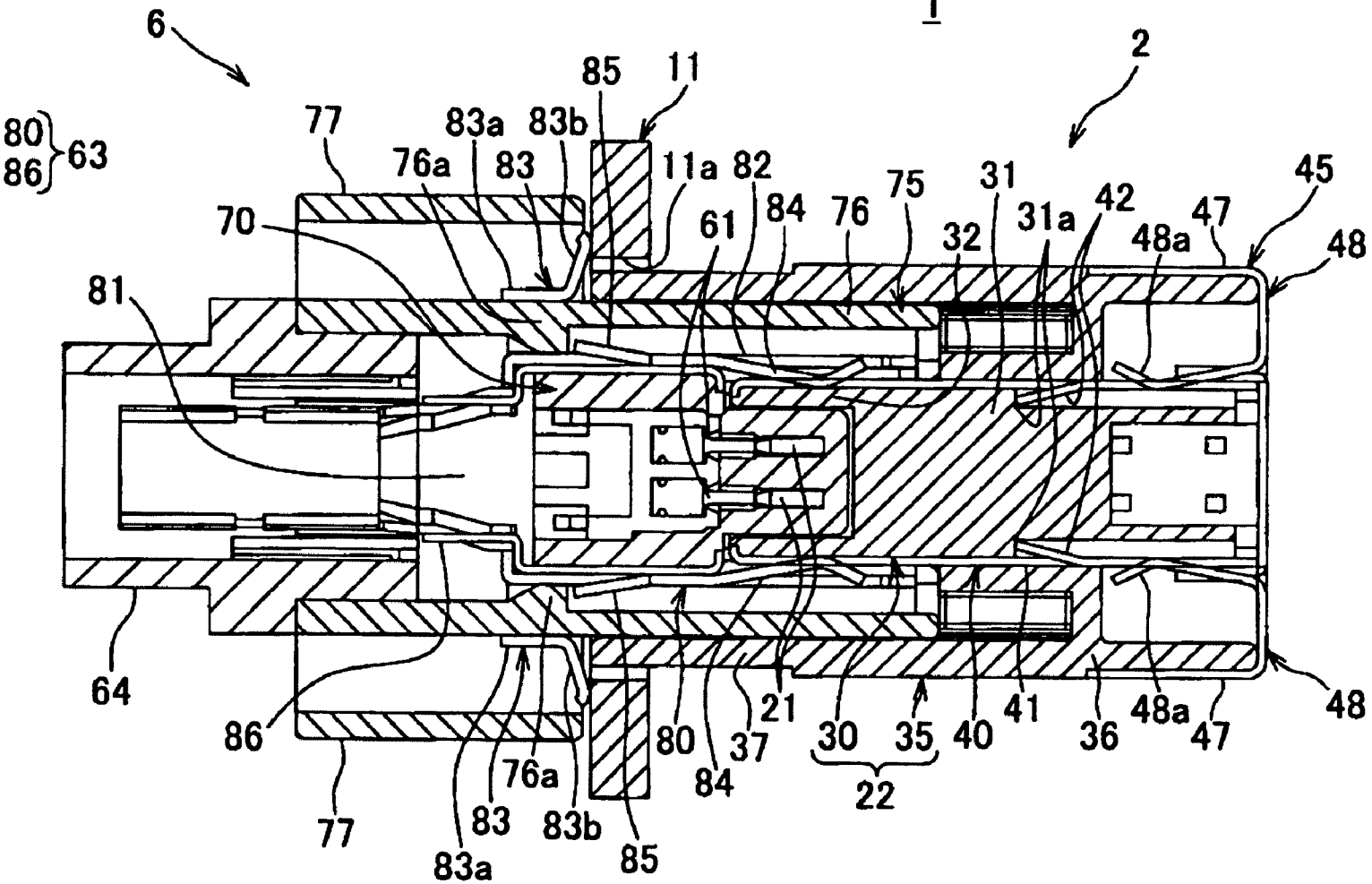
FIG. 3 is a cross-sectional view of the state wherein the pair of connectors in FIG. 2 are engaged.

The connector mounting portion 11 is mounted in the body, for example, of an electronic apparatus. The connector mounting portion 11 is shaped like a plate, as shown in FIG. 2, for example, and is made of a conductive metal. A hole 11*a* through which the first connector 2 is inserted, is formed in the connector mounting portion 11, as are screw holes used for fastening to the connector mounting portion 11 an outer shield shell 45 of the first connector 2, which will be described later.

When the connectors 2 and 6 are engaged and the shield shells 23 and 63 are shied-connected, connecting portions 49 and 83 of the shield shells 23 and 63, which will be described later, are connected to the connector mounting portion 11. Furthermore, electrical noise originating at the metal terminal elements 21 and 61, which could leak externally or which could enter the shield shell interior, is flowed to the shield shells 23 and 63 and the connector mounting portion 11 and is discharged to an electronic apparatus via a grounded connection.

Figure 6:
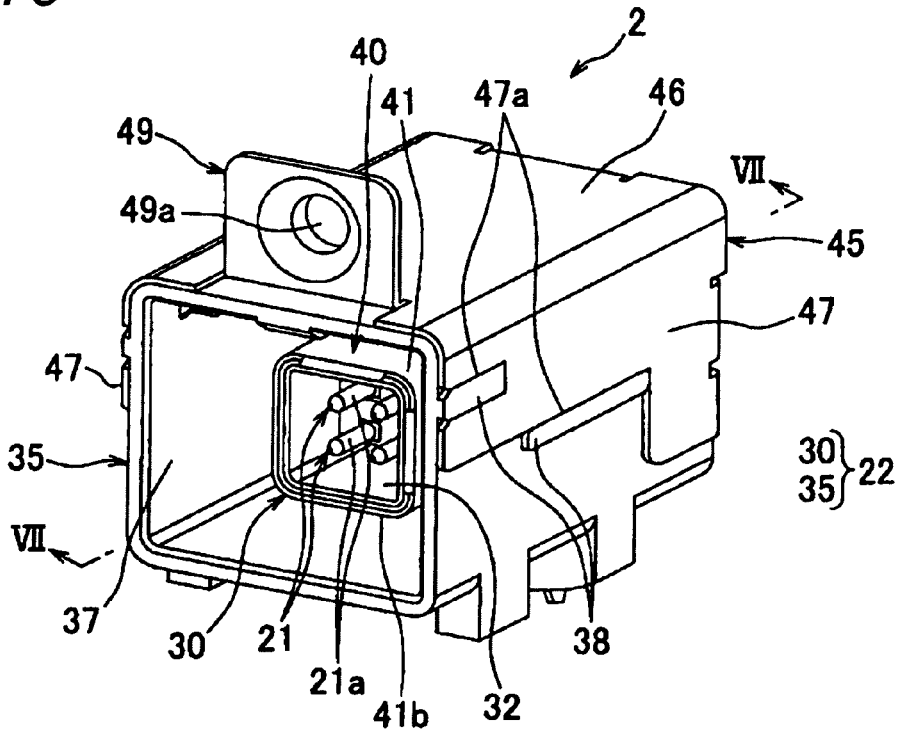
FIG. 6 is a perspective view of a first connector shown in FIG. 1.
Figure 7:
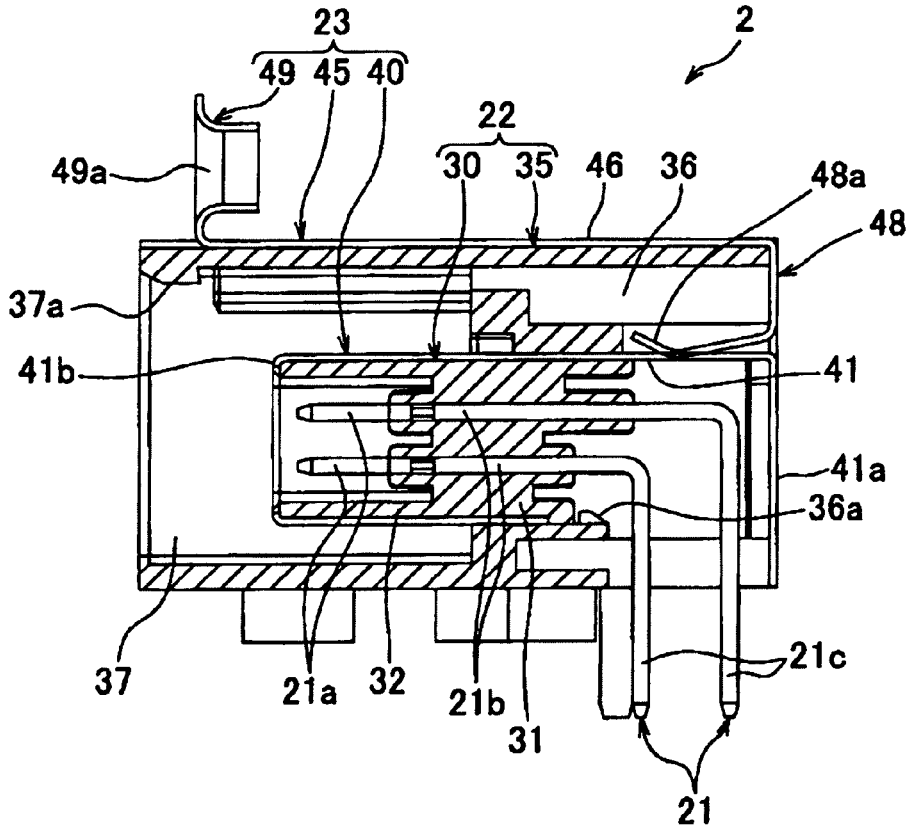
FIG. 7 is a cross-sectional view taken along line VII-VII in FIG. 4.

Referring to the pair of connectors 2 and 6, as shown in FIGS. 6 and 7, the first connector 2 includes the metal terminal elements 21, an insulating connector housing 22, wherein a terminal container 30 is arranged to store the metal terminal elements 21, and a conductive shield shell 23 which covers, at the least, the terminal container 30 of the connector housing 22.

The metal terminal elements 21 are L-shaped rods, made of a conductive metal, and multiple (in this case, four) rods are provided. Each metal terminal element 21 is composed of: an electric contact portion 21*a* which is contiguously formed with an adjacent portion at one end of the L-shaped metal terminal element 21; a terminal portion 21*c* which is contiguously formed with the other end of the L-shaped metal terminal element 21 and is exposed outside the first connector 2; and a holding portion 21*b* which is contiguously formed between the contact portion 21*a* and the terminal portion 21*c* and is secured inside a main body 31 of the terminal container 30. The metal terminal elements 21 are so arranged, in the terminal container 30, that the electric contact portions 21*a* are parallel to the axis of the connector housing 22, the horizontal and the vertical parts of the L-shaped terminal portions 21*c* are respectively parallel and perpendicular to the axis of the connector housing 22, and the terminal portion 21*c* is perpendicular to the axis of the connector housing 22.

As shown in FIGS. 6 and 7, the connector housing 22 includes an outer housing 35 and the terminal container 30 arranged within it. The terminal container 30 is made, for example, of an insulating synthetic resin that is formed, on the whole, substantially as a prism. Furthermore, the terminal container 30 includes: the main body 31 which is located at one end in the longitudinal direction and is used to store the holding portions 21*b* of the metal terminal elements 21; and an inner hood portion 32 into which the electric contact portions 21*a* of the metal terminal elements 21 are projected, that is located, in the longitudinal direction, at the other end of the terminal container 30. Step portions 31*a* are formed as paired step faces on the main body 31, and engagement pieces 42, for an inner shield 40 that will be described later, are fitted into the step portions 31*a*.

The outer housing 35 is made, for example, of an insulating synthetic resin, and is shaped, on the whole, as a nearly prism. The outer housing 35 includes: a main body 36 which is located at one end of the outer housing 35 in the longitudinal direction, and is used to store the terminal container 30 into which the inner shield shell 40, which will be described later, is fitted; an outer hood portion 37, which is located at the other end of the outer housing 35, in the longitudinal direction, into which that the terminal container 30 can be projected; and a plurality of projections 38 which are formed on the outer surface of the main body 36 and the outer hood portion 37, and are fitted into notches 47*a*, in the outer shield shell 45, that will be described later.

Part of the main body 36, as formed, is small, so that the inner diameter is equal to the outer diameter of the inner shield shell 40. On the inner wall of the main body 36, at a distance from the outer hood portion 37, a projection 36*a* is formed inward to engage the end of the terminal container 30. In addition, on the inner wall of the distal end of the outer hood portion 37, a lock portion 37*a* is projected inward to engage a lock arm 79 of the second connector 6, which will be described later.

As shown in FIGS. 6 and 7, the shield shell 23 includes: the inner shield shell 40 which covers the terminal container 30; the outer shield shell 45 which is provided separately from the inner shield shell 40 and which covers the outer housing 35 while contacting the inner shield shell 40; and a connecting portion 49 which is provided on the outer shield shell 45 and is to be connected to the connector mounting portion 11.

The inner shield shell 40 is made of a conductive metal material, and is formed, for example, by bending a metal sheet. The inner shield shell 40 includes: a barrel portion 41 fitted over the terminal container 30; and a pair of engagement pieces 42 (see, for example, FIG. 2) that are contiguously formed with the barrel portion 41 and are projected inside the barrel portion 41.

At one longitudinal end, the barrel portion 41 is open in a direction parallel to the longitudinal direction. Further, at this longitudinal end of the barrel portion 41, an inwardly bent portion 41*b* is formed around the barrel portion 41. At the other longitudinal end of the barrel portion 41, by using a folded portion 41*a* to cover that end of the barrel portion 41, an opening is formed in a direction that is perpendicular to the longitudinal direction.

The engagement pieces 42 are provided on positioning the axis of the barrel portion 41 between them. The engagement pieces 42 are formed, like tie plates, in the direction in which the connectors 2 and 6 are brought into contact or are separated (i.e., the connectors 2 and 6 are engaged or disengaged). The ends of the engagement pieces 42 nearest the second connector 6 are free ends, while the ends furthest from the second connector 6 are connected to the barrel portion 41. The free ends of the engagement pieces 42 are flexible, so that the engagement pieces can be moved in near the inner wall of the barrel portion 41.

When the terminal container 30 is inserted into the inner shield shell 40 having the above described arrangement, the engagement pieces 42 for the inner shield shell 40 are fitted into the step portions 31*a* in the terminal container 30 (FIG. 2), and the bent portion 41*b* of the inner shield shell 40 is fitted around the distal end of the inner hood portion 32 of the terminal container 30 (FIG. 7). Thus, the terminal container 30 is held inside the inner shield shell 40, i.e., the inner shield shell 40 is attached to the terminal container 30. As a result, the inner shield shell 40 is arranged so the entire terminal container 30 is covered.

The outer shield shell 45 is made of a conductive metal, and is formed, for example, by bending a metal sheet. The outer shield shell 45 includes: an upper plate 46 which overlaps the top face of the outer housing 35; a pair of side plates 47 which are contiguously formed with the two widthwise ends of the upper plate 46 and which overlap the side faces of the outer housing 35; and folded portions 48 which are provided respectively for the upper plate 46 and the pair of side plates 47.

The distance between the side plates 47 is slightly smaller than the distance between the side faces of the outer housing 35, and multiple notches 47*a*, into which the projections 38 on the outer housing 35 are inserted, are formed in the side plates 47.

The folded portions 48 are formed, so they are almost L-shaped in cross section, by being extended from the longitudinal ends of the upper plate 46 and the side plates 47, and then being folded, at their ends, into the outer shield shell 45. Distal ends 48*a* of the folded portions 48, i.e., the portions substantially parallel either to the upper plate 46 or the side plates 47, are arranged so they can be elastically deformed, and the folded portions 48 moved nearer the inner wall of the outer shield shell 45.

The connecting portion 49 is located on the other longitudinal end of the upper plate 46. The connecting portion 49 is formed by bending the end of the upper plate 46 until the connecting portion 49 is perpendicular to the upper plate 46. The plan shape of the connecting portion 49 is almost rectangular, and a screw hole 49*a* is formed through its center. Thereafter, the screw hole 49*a* in the connecting portion 49 is aligned with the screw hole in the connector mounting portion 11, and a bolt 12*a* is inserted through these holes and is fastened by a nut 12*b*, to fix the first connector 2 to the connector mounting portion 11.

The outer shield shell 45 having the above described arrangement is attached to the outer housing 35 by inserting the projections 38 of the outer housing 35 along the notches 47*a*. Then, the side plates 47 hold the outer housing 35, and the outer shield shell 45 is supported by the outer face of the outer housing 35, i.e., the outer shield shell 45 is mounted on the outer housing 35.

According to the above described arrangement for the first connector 2, the terminal container 30 wherein the inner shield shell 40 is mounted, is inserted into the outer housing 35 wherein the outer shield shell 45 is mounted, and is held in the portion where the inner diameter of the main body 31 is reduced. At this time, the distal ends 48*a*, of the folded portions 48, that contact the outer shield shell 45 are elastically deformed at the outer wall of the inner shield shell 40 and generate a restoring force and press against the outer wall of the inner shield shell 40, bringing the outer shield shell 45 into contact with the inner shield shell 40 and holding the terminal container 30 in the outer housing 35. Furthermore, referring to FIG. 7, the end of the terminal container 30 contacts the projection 36*a* of the outer housing 35 and prevents the terminal container 30 from falling off to the right of the outer housing 35.

Figure 4:
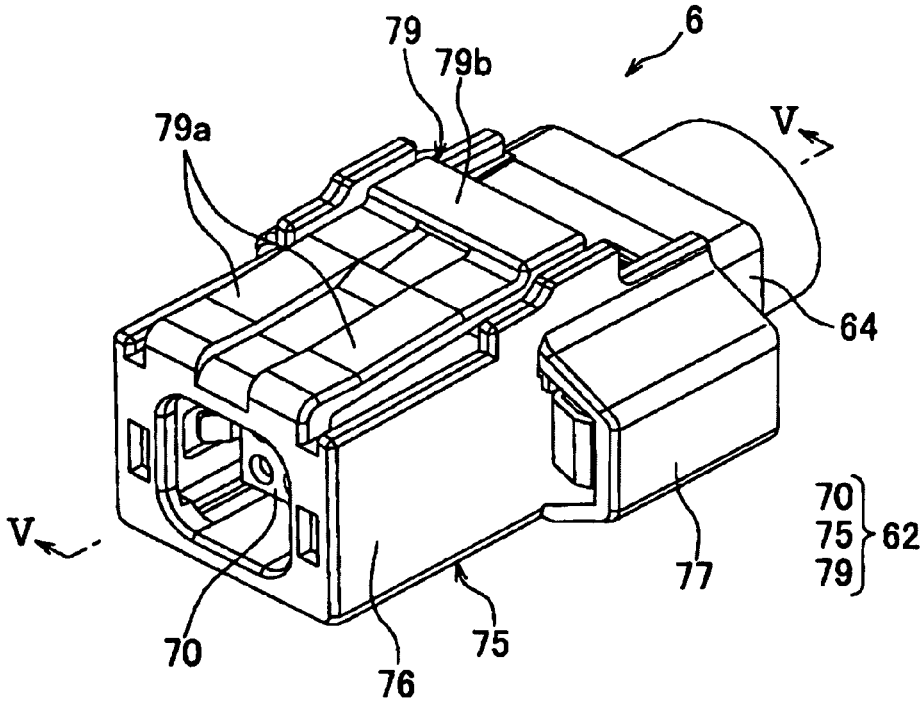
FIG. 4 is a perspective view of a second connector in FIG. 1.
Figure 5:
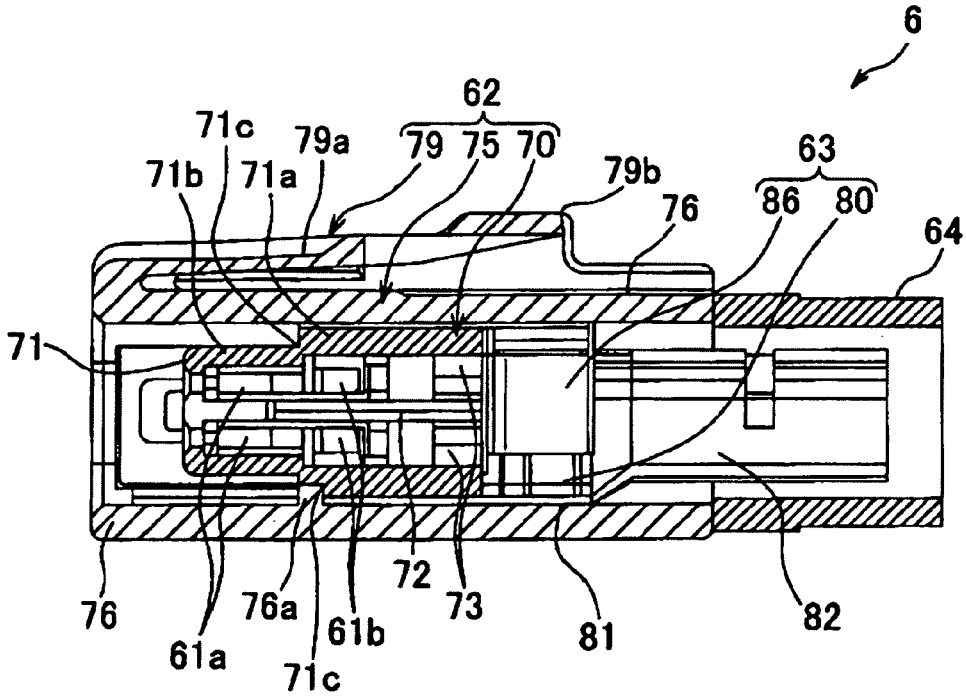
FIG. 5 is a cross-sectional view taken along line V-V in FIG. 4.

The second connector 6, as shown in FIGS. 4 and 5, includes: the metal terminal elements 61; an insulating connector housing 62 wherein a terminal container 70 is arranged for storing the metal terminal elements 61; the conductive shield shell 63 which at least covers the terminal container 70 of the connector housing 62; and a rear holder 64.

The metal terminal elements 61 are formed, for example, by bending a conductive metal sheet, and multiple (four in this case) such metal terminal elements 61 are provided. The metal terminal elements 61 are formed of electric contact portions 61*a* which contact the metal terminal elements 61 of the first connector 2, and wire connecting portions 61*b* which are connected to a wire by compression bonding.

The electric contact portions 61*a* are cylindrical, and are open opposite the metal terminal elements 21 of the first connector 2. With this arrangement, the electric contact portions 21*a* of the metal terminal elements 21 of the first connector 2 can be inserted into the electric contact portions 61*a*, electrically connecting the metal terminal elements 21 and 61. A plurality of calking pieces are formed for the wire connecting portions 61*b*, and are used to calk the terminals of wires to ensure that the wire connecting portions 61*b* and the cores of the wires are electrically connected.

The connector housing 62 is formed of the terminal container 70, an outer housing 75 which is located outside the terminal container 70, and a lock arm 79 which is contiguously formed with the outer housing 75.

The terminal container 70 is made, for example, of an insulating synthetic resin, and includes: a main body 71 having substantially a square column shape; a terminal holder 72 which is a thick plate, held in the main body 71, to which the metal terminal elements 61 are attached; and a cylindrical wire cover 73 which covers wires connected to the metal terminal elements 61.

The main body 71 is formed of a large diameter portion 71*a* located at one end in the longitudinal direction; a small diameter portion 71*b* located at the other end in the longitudinal direction; and a step portion 71*c* located along the outer wall of the main body 71 between the large diameter portion 71*a* and the small diameter portion 71*b*. The outer diameter and the inner diameter of the large diameter portion 71*a* are greater than those of the smaller diameter portion 71*b*. The terminal holder 72 and the wire cover 73 are stored in the large diameter portion 71*a*, and an upper shield shell 86 of the shield shell 63, which will be described later, is mounted on the outer wall of the large diameter portion 71*a*. The metal terminal elements 61 are arranged so extended inside the large diameter portion 71*a* and the small diameter portion 71*b*.

The outer housing 75, on the whole, is shaped almost like a prism, and is obtained by integrally forming a pair of short sleeves 77 on the outer wall of a main body 76 which is used to store the terminal container 70 where the shield shell 63 is attached.

A plurality of engagement protrusions 76*a* are projected inward from the inner wall of the main body 76. The engagement protrusions 76*a* engage the step portion 71*c* of the main body 71 of the terminal container 70 and engagement pieces 85 of a lower shield shell 80, which will be described later.

The lock arm 79 is projected outward from the outer wall of the outer housing 75, and includes: a pair of arm main bodies 79*a* which are contiguously formed with the outer housing 75, and a lock portion 79*b* which is raised from the outer wall of the arm main body 79*a*.

The pair of arm main bodies 79*a* are extended from one end of the outer housing 75 opposite the first connector 2, in a direction in which the connectors 2 and 6 are brought into contact or are separated. Also, the arm main bodies 79*a* are arranged parallel to each other, at an interval, and are elastically deformed so they move near the outer wall of the outer housing 75. The lock portion 79*b* is provided at the distal end of the arm main bodies 79*a*, and couples them in a direction that is perpendicular to the longitudinal direction of the arm main bodies 79*a*.

With this arrangement, when the outer housing 75 of the second connector 6 is inserted into the outer housing 35 of the first connector 2, the lock portion 79*b* of the lock arm 79 abuts on the lock portion 37*a* provided on the outer housing 35 of the first connector 2, and the arm main bodies 79*a* are elastically deformed and moved near the outer wall of the outer housing 75. Then, when the lock portion 79*b* is moved across the lock portion 37*a* of the first connector 2, the arm main bodies 79*a* recover to their original shape, and the lock portions 37*a* and 79*b* are engaged. As a result, the state is maintained wherein the connectors 2 and 6 are fitted together.

The shield shell 63 includes the upper shield shell 86 and the lower shield shell 80. The upper shield shell 86 is made of a conductive metal, and is formed substantially like a rectangular gutter (U-shaped in cross section) by bending a metal sheet, for example. The width of the upper shield shell 86 is slightly less than the width of the large diameter portion 71*a* of the terminal container 70, and the upper shield shell 86 is mounted on the large diameter portion 71*a* to cover the upper face (top side in FIG. 5) and the side faces of the large diameter portion 71*a* of the terminal container 70.

The lower shield shell 80 is made of a conductive metal, and is formed, for example, by bending a metal sheet. The lower shield shell 80 has substantially a rectangular gutter shape (U-shaped in cross section), and includes: a bottom plate 81 (see, for example, FIG. 2) formed like a tie plate; and a pair of side plates 82 (see, for example, FIG. 2), formed upright from the widthwise ends of the bottom plate 81.

With this arrangement, the terminal container 70, where the upper shield shell 86 is fitted, is attached to one end of the lower shield shell 80 in the longitudinal direction. At this time, the lower shield shell 80 is mounted to cover the lower face (lower side in FIG. 5) and the side faces of the terminal container 70. The lower shield shell 80 and the upper shield shell 86 are arranged so they cover the entire terminal container 70, i.e., all the metal terminal elements 61. Wires connected to the metal terminal elements 61 are arranged, in the longitudinal direction, at the other end of the lower shield shell 80.

As shown in FIG. 2, for example, each of the side plates 82 includes a connecting portion 83, a contact piece 84 and an engagement piece 85. The connecting portions 83 project respectively from the outer walls of the side plates 82, and are formed of coupling pieces 83*a* which are contiguously arranged with the side plates 82, and connection pieces 83*b* which are rectangular plates, provided at the distal ends of the coupling pieces 83*a* that are perpendicular to the side plates 82. The connection pieces 83*b* are arranged so they are elastically deformed in a direction separate from that of the longitudinal end of the lower shield shell 80, i.e., in a direction separate from that of the connector mounting portion 11. When the terminal container 70 is inserted into the outer housing 75 while the lower shield shell 80 is attached, most portions of the connecting portions 83 are stored in the short sleeves 77 of the outer housing 75, and only a few of the connecting portions 83*b* project out of the short sleeves 77.

According to the above described arrangement, the connecting portions 83 are so arranged that when the second connector 6 is moved near the first connector 2, the connecting portions 83 are projected outward toward the connector mounting portion 11. When the connectors 2 and 6 are engaged and the inner shield shell 40 of the first connector 2 is shield-connected to the shield shell 63 of the second connector 6, the connection pieces 83*b* that contact the connector mounting portion 11 are elastically deformed, and generate a restoring force, while pressing against the connector mounting portion 11. Then, the connecting portions 83 (i.e., the shield shell 63) and the connector mounting portion 11 are connected.

The contact pieces 84 provided respectively for the side plates 82, are formed by cutting required portions of the side plates 82 and bending the portions toward the inside of the lower shield shell 80. The contact pieces 84 are shaped like tie plates and are arranged in a direction in which the connectors 2 and 6 are brought into contact or are separated. The ends of the contact pieces 84 nearest the first connector 2 are free ends, while the other ends, which are furthest from the first connector 2, are coupled with the side plates 82. The contact pieces 84 are bent in the center, in the longitudinal direction, and the interval between the contact pieces 84 is greater on the base end side and on the distal end side, and is smaller at the folded portion (center portion). The contact pieces 84 are arranged parallel to each other, and are elastically deformed in a direction in which the interval between the contact pieces 84 is increased.

With this arrangement, when the connectors 2 and 6 are engaged, the contact pieces 84 are elastically deformed and positioned on the inner shield shell 40 of the first connector 2, between the contact pieces 84. Thereafter, following application of the restoring force, the contact pieces 84 are positioned so they securely hold the inner shield shell 40. As a result, the contact pieces 84 (i.e., the shield shell 63) and the inner shield shell 40 are connected.

The pair of engagement pieces 85 which are shaped like tie plates, are respectively projected from the outer walls of the side plates 82 in a direction in which the connectors 2 and 6 are brought into contact, or are separated. The ends of the engagement pieces 85 nearest the first connector 2 are contiguously formed with the side plates 82, while the other ends, which are furthest from the first connector 2, are free ends that are elastically deformed and moved near the side plates 82. The engagement pieces 85 engage the engagement protrusions 76*a* of the outer housing 75.

The rear holder 64 is attached to the end of the outer housing 75 that is furthest from the first connector 2. The rear holder 64, as formed, is a prism through which wires connected to the metal terminal elements 61, can be passed.

According to the arrangement for the second connector 6, the terminal container 70 wherein the upper shield shell 86 and the lower shield shell 80 are fitted, is inserted into the outer housing 75. Then, as shown in FIG. 5, the step portion 71*c* of the main body 71 of the terminal container 70 engages the engagement protrusions 76*a* of the outer housing 75. Therefore, as shown in FIG. 5, the terminal container 70 is prevented from falling off the outer housing 75 to the left. In addition, as shown in FIG. 2, the engagement pieces 85 of the lower shield shell 80 engage the engagement protrusions 76*a* of the outer housing 75, so that the terminal container 70 is prevented from falling off the outer housing 75 to the left of FIG. 2.

For the connectors 2 and 6 having the above described arrangements to be engaged, first, the connecting portion 49 of the first connector 2 is fixed to the connector mounting portion 11 with a screw. Following this, the outer housing 75 of the second connector 6 is inserted into the outer housing 36 of the first connector 2, and the small diameter portion 71*b* of the terminal container 70 of the second connector 6 is inserted into the inner hood portion 32 of the terminal container 30 of the first connector 2.

As a result, the inner shield shell 40 of the first connector 2 is gripped between the contact pieces 84 of the lower shield shell 80 of the second connector 6, and the lower shield shell 80 and the inner shield shell 40 contact each other. Sequentially, when the second connector 6 is moved nearer the first connector 2, the connectors 2 and 6 are engaged and the metal terminal elements 21 and 61 are electrically connected. At this time, the distal end of the upper shield shell 86 and the distal end of the inner shield shell 40 are brought into contact, and the upper shield shell 86 and the inner shield shell 40 (i.e., the shield shells 23 and 63) are shied-connected.

Also, at this time, the connection pieces 83*b* of the connecting portions 83 provided on the lower shield shell 80 of the second connector 6, are elastically deformed, through contact with the connector mounting portion 11, and generate a restoring force used to press against the connector mounting portion 11. In this manner, the connecting portions 83 of the second connector 6 are connected to the connector mounting portion 11.

In the pair of connectors 2 and 6 that are engaged in the above described manner, noise that is blocked by the inner shield shell 40 of the first connector 2 is sequentially flowed from the outer shield shell 45 to the connecting portion 49 and then to the connector mounting portion 11, and is discharged to an electronic apparatus via a grounded connection, while noise that is trapped and blocked by the shield shell 63 of the second connector 6 is sequentially transferred from the connecting portions 83 to the connector mounting portion 11, and is discharged to an electronic apparatus via a grounded connection. In this manner, noise blocked by either the inner shield shell 40 or the shield shell 63 is discharged directly to an electronic apparatus via a grounded connection, without being transferred to the other shield shell of the second connector 6.

According to this embodiment, the connecting portions 49 and 83 are provided respectively on the shield shells 23 and 63 of the connectors 2 and 6, and are connected to the connector mounting portion 11 when the connectors 2 and 6 are engaged and the shield shells 23 and 63 are shied-connected. Therefore, noise blocked by the shield shells 23 and 63 is transferred, as a return current, directly to the connector mounting portion 11 and is discharged externally. Thus, since noise can be discharged by reducing the length of a path along which a return current flows, appropriate shielding effects can be obtained.

The connecting portions 83 are projected toward the connector mounting portion 11, and when the connectors 2 and 6 are engaged, the connecting portions 83 are elastically deformed and generate a restoring force for pressing against the connector mounting portion 11. Thus, the connecting portions 83 are properly connected to the connector mounting portion 11, and therefore, noise can be appropriately discharged and a satisfactory shielding property exhibited.

Second Embodiment

A shielded connector structure 1 according to a second embodiment of the present invention will now be described while referring to FIGS. 8 to 14. The same reference numerals used for the first embodiment are provided on identical or corresponding components, and no further explanation for them will be given.

Figure 8:
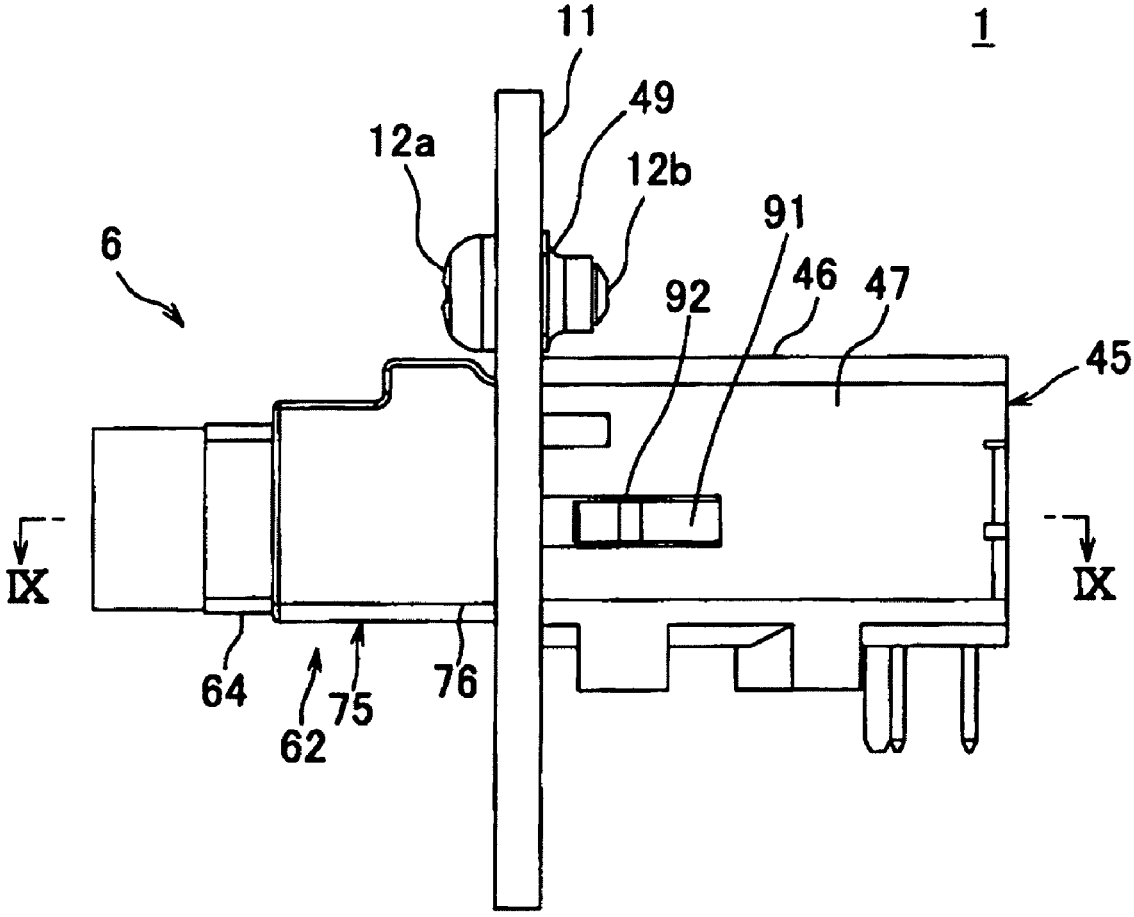
FIG. 8 is a side view of a shielded connector structure according to a second embodiment of the present invention.

As shown in FIG. 8, the shield connector structure 1 for the second embodiment includes: a pair of connectors 2 and 6, which engage each other and which include shield shells 23 and 63 respectively; and a conductive connector mounting portion 11, which contacts and grounds the shield shell 23. When the connectors 2 and 6 are engaged, the shield shells 23 and 63 are shied-connected.

In this embodiment, unlike in the first embodiment, connecting portions 83 are not formed on a lower shield shell 80 of the second connector 6, and instead, second connecting portions 91 are formed on an outer shield shell 45 of the first connector 2.

Figure 9:
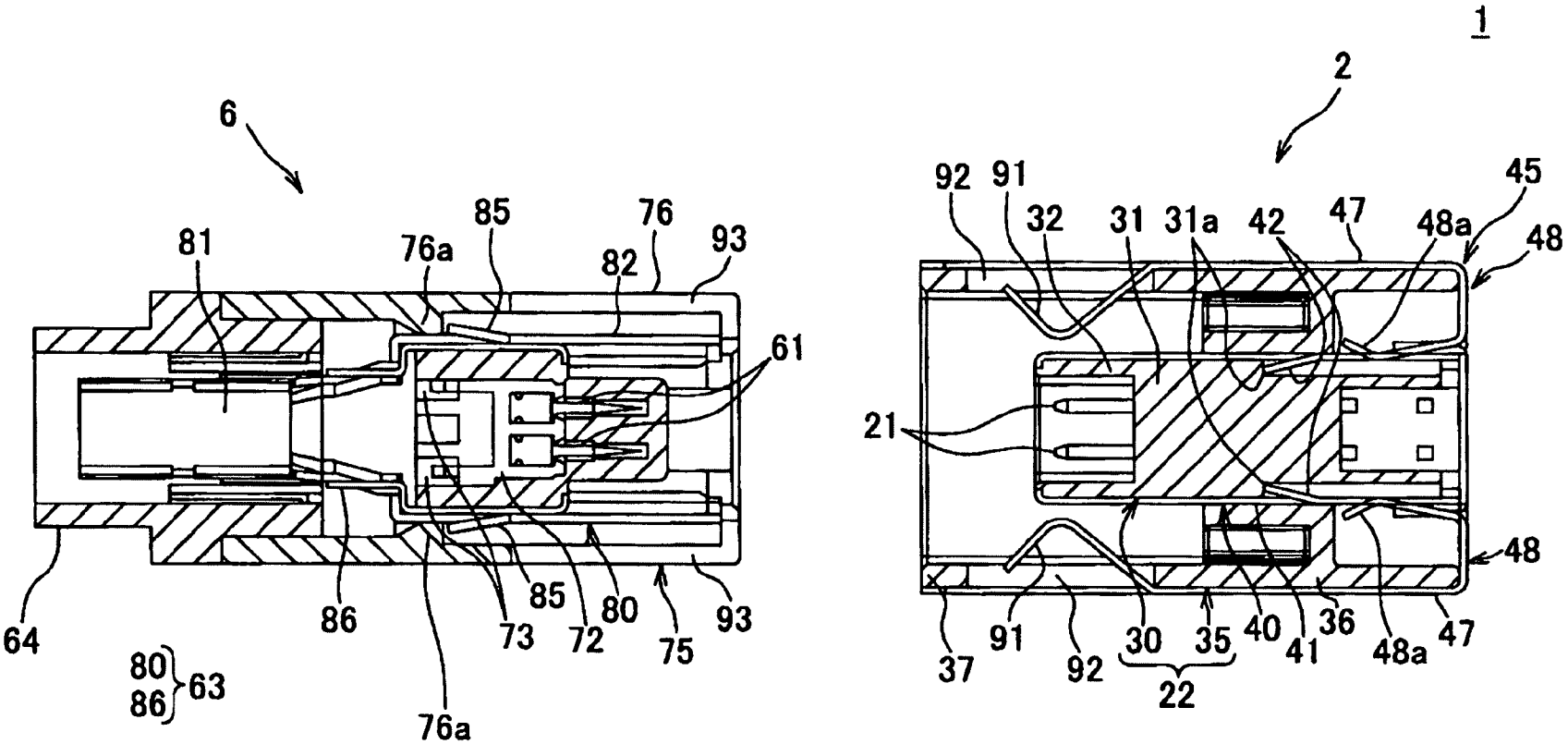
FIG. 9 is a cross-sectional view, taken along line IX-IX, of the state before a pair of connectors in FIG. 8 are engaged.
Figure 10:
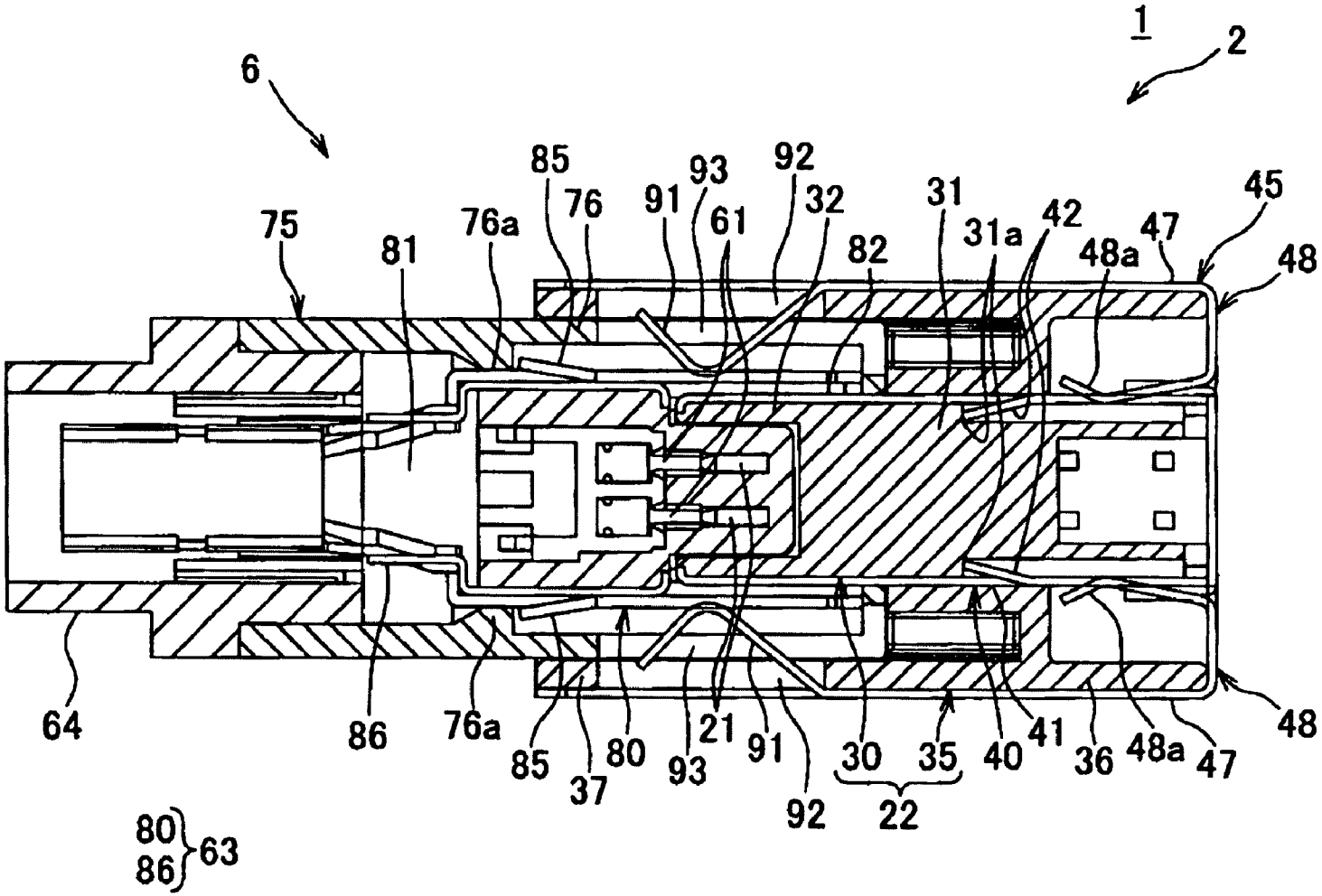
FIG. 10 is a cross-sectional view of the state wherein the pair of connectors in FIG. 9 are engaged.
Figure 13:
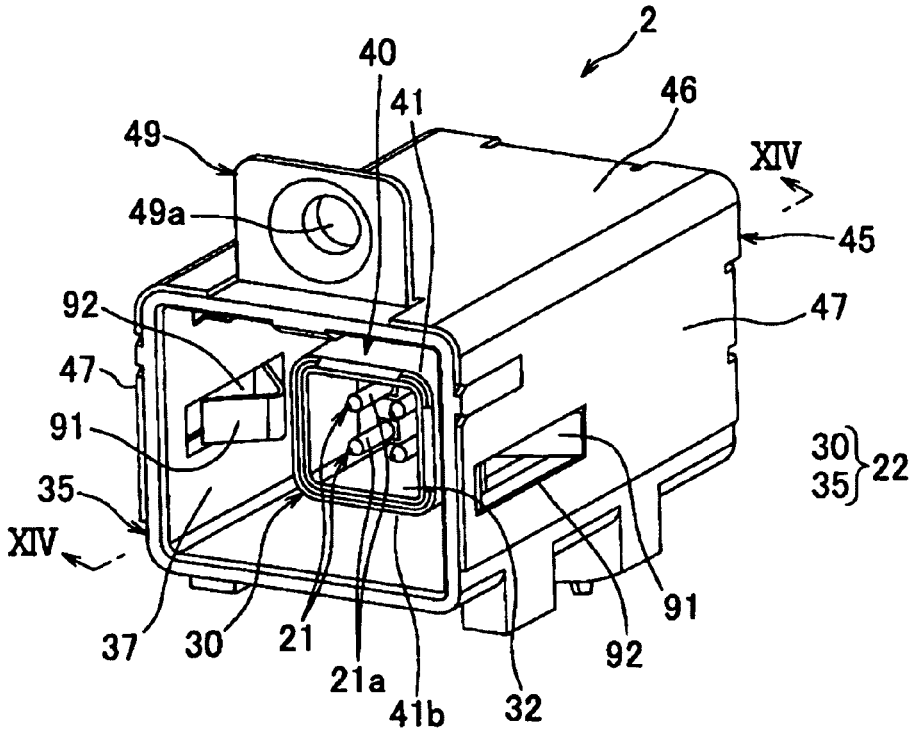
FIG. 13 is a perspective view of a first connector in FIG. 8.
Figure 14:
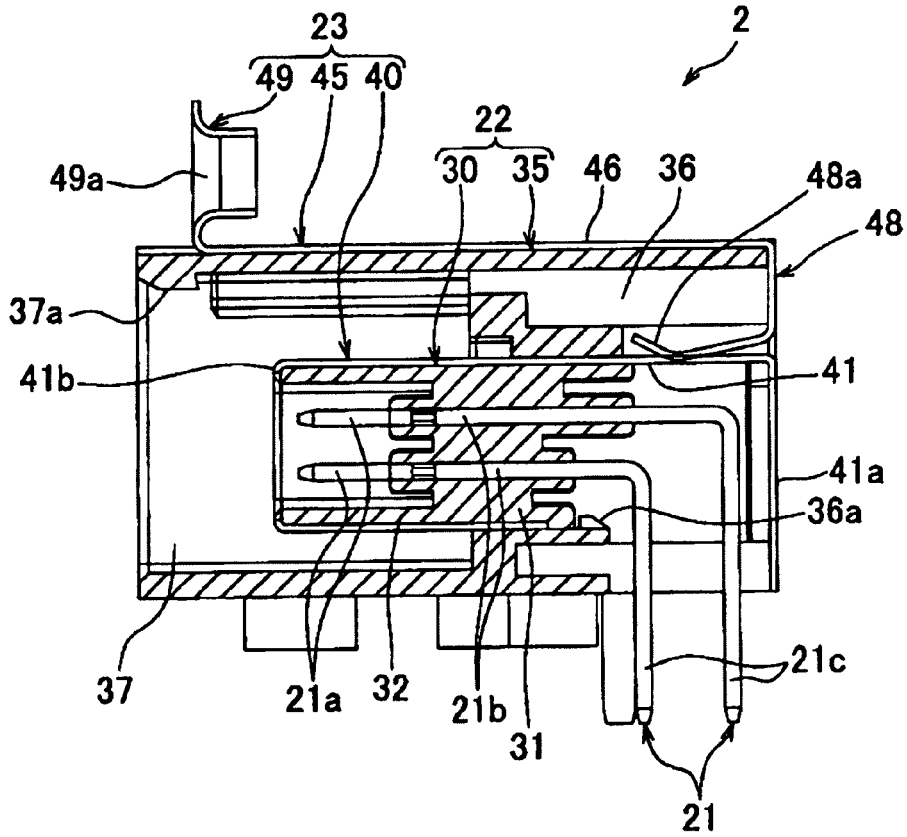
FIG. 14 is a cross-sectional view of line XIV-XIV in FIG. 13.

As shown in FIGS. 9 and 13, the individual second connecting portions 91 are formed by cutting portions of respective side plates 47 of the outer shield shell 45, and then bending these portions so they are inside the outer shield shell 45. The second connecting portions 91 are shaped like tie plates in a direction in which the connectors 2 and 6 are to engage, and the ends nearest the second connector 6 are free ends, while the ends furthest from the second connector 6 are contiguously formed with the side plates 47. The second connecting portions 91 are folded at their longitudinal center locations, and the distance between the second connecting portions 91 is large at the base end side and the distal end side, and is small at the folded portion (the center portion). The second connecting portions 91 are arranged opposite each other, at a specific distance, and are elastically deformed to move nearer the side plates 47 (i.e., to be further separated from each other).

Further, a pair of holes 92 are formed in the outer housing 35 of the first connector 2 into which to insert the second connecting portions 91. The holes 92 pass linearly through an outer hood portion 37 of the outer housing 35, in a direction in which the connectors 2 and 6 are brought into contact or are separated, and are located at positions corresponding to the second connecting portions 91. Through the holes 92, the second connecting portions 91 are projected into the outer housing 35.

Figure 11:
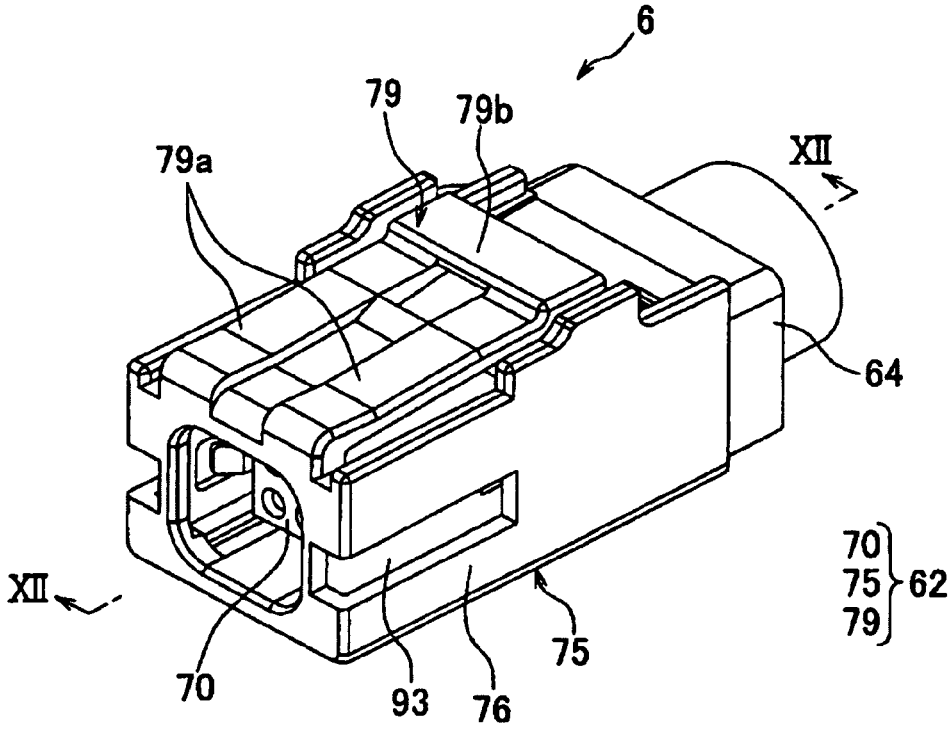
FIG. 11 is a perspective view of a second connector in FIG. 8.
Figure 12:
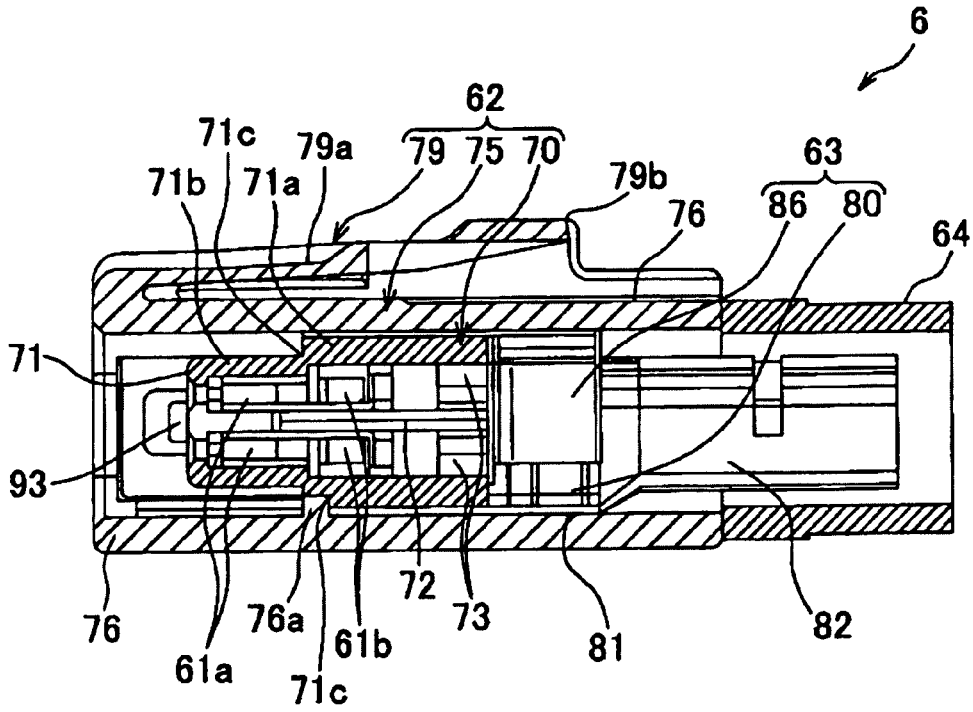
FIG. 12 is a cross-sectional view taken along line XII-XII in FIG. 11.

In addition, as shown in FIGS. 9 and 11, a pair of second holes 93 are formed in the outer housing 75 of the second connector 6. When the connectors 2 and 6 are engaged, the second holes 93 communicate with the holes 92 and allow the second connecting portions 91 to pass through. The second holes 93 pass linearly through a main body 76 of the outer housing 75 from the end of the outer housing 75 opposite the first connector 2, in a direction in which the connectors 2 and 6 are brought into contact or are separated. The second holes 93 are located at positions corresponding to the second connecting portions 91, and the lower shield shell 80 is externally exposed through the second holes 93.

With this arrangement, the second connecting portions 91 pass through the holes 92 and are projected into the outer housing 35 of the first connector 2. When the second connector 6 is moved near the first connector 2, the second connecting portions 91 are projected toward the shield shell 63 (the lower shield shell 80), and when the second connector 6 is still nearer the first connector 2, the second connecting portions 91 pass through the second holes 93 and are connected to the lower shield shell 80. Then, the second connecting portions 91 are elastically deformed to move near the side plates 47, to position the lower shield shell 80 between the second connecting portions 91, and to, thereafter, generate a restoring force to hold the lower shield shell 80 between them.

Noise trapped and blocked by an inner shield shell 40 of the first connector 2 is sequentially transferred from the outer shield shell 45 to a connecting portion 49 and then to the connector mounting portion 11, and is discharged to an electronic apparatus via a grounded connection. On the other had, noise blocked by the shield shell 63 of the second connector 6 is received by the first connector 2, through the second connecting portions 91, and is then transferred to the outer shield shell 45 and the connector mounting portion 11, and is discharged to an electronic apparatus via a grounded connection. As described above, noise blocked by the shield shell 23 of the first connector 2 is directly discharged to an electronic apparatus via a grounded connection, while noise blocked by the shield shell 63 of the second connector 6 is transferred from the outer shield shell 45 of the first connector 2, along a short path, and is discharged to an electronic apparatus via a grounded connection.

According to this embodiment, the second connecting portions 91 are provided on the outer shield shell 45 for connection to the lower shield shell 80 of the second connector 6. Therefore, noise blocked by the outer shield shell 63 of the second connector 6 is flowed, as a return current, through the outer shield shell 45 of the first connector 2 to the connector mounting portion 11, and is externally discharged. Thus, noise can be effectively discharged, by reducing the length of a path along which a return current flows, and a satisfactory shielding property exhibited.

Further, the second connecting portions 91 are projected, from the outer shield shell 45, toward the lower shield shell 80 of the second connector 6, and when they contact the lower shield shell 80 while the connectors 2 and 6 are engaged, are elastically deformed and generate a restoring force for pressing against the lower shield shell 80. Thus, the second connecting portions 91 and the lower shield shell 80 can be appropriately connected, and noise can be appropriately discharged and a satisfactory shielding property exhibited.

Furthermore, since the holes 92 are formed, in the outer housing 35 of the first connector 2, to pass the second connecting portions 91 through, the second connecting portions 91, by passing through the holes 92, can be connected to the lower shield shell 80 of the second connector 6. With this arrangement, the second connecting portions 91 and the lower shield shell 80 can be appropriately connected.

In addition, since the second holes 93 are formed, in the outer housing 75 of the second connector 6, to permit the second connecting portions 91 to pass through, the second connecting portions 91, by passing through the second holes 93, can be connected to the lower shield shell 80 of the second connector 6. Therefore, the second connecting portions 91 and the lower shield shell 80 can be appropriately connected.

In this embodiment, the second connecting portions 91 are provided on the outer shield shell 45 of the first connector 2. However, according to this invention, the second connecting portions 91 may also be provided on the shield shell 63 (the upper shield shell 86 or the lower shield shell 80) of the second connector 6.

The above described embodiments of the present invention are merely examples, and the present invention is not limited to these embodiments. That is, the present invention can be variously modified and applied without departing from the scope of the invention.

What is claimed is:

1. A shielded connector structure, comprising:

a first connector and a second connector, each including:

a metal terminal element;

an insulating connector housing comprising an outer housing and a terminal container arranged within the outer housing for accommodating the metal terminal elements, the terminal container comprising a main body and an interior; and a conductive shield shell located at least between the terminal container and the outer housing, which covers the terminal container of the connector housing;

a conductive connector mounting portion which contacts the shield shell of at least one of the first and second connectors to ground the shield shell;

a connecting portion which is provided on each of the shield shells of the first and second connectors, and is coupled to the connector mounting portion when the first and second connectors are engaged to shield-connect the shield shells each other; and a contact piece connecting the shield shells of the first and second connectors to each other when the first and second connectors are engaged.

2. The shielded connector structure according to claim 1, wherein at least one of the connecting portions is projected toward the connector mounting portion, so that when the first and second connectors are engaged each other, the connecting portion is elastically deformed while contacting the connector mounting portion to generate an elastic restoring force for pressing the connector mounting portion.

3. The shielded connector structure according to claim 1, wherein the terminal container is made of an insulating synthetic resin.

4. A shielded connector structure, comprising:

a first connector and a second connector, each including:

a metal terminal element;

an insulating connector housing that has a terminal container for accommodating the metal terminal elements, the terminal container comprising a main body and an interior; and a conductive shield shell which covers the terminal container of the connector housing;

a conductive connector mounting portion which contacts the shield shell of the first connector to ground the shield shell; and a first connecting portion which is provided on the shield shell of the first connector, and is coupled to the connector mounting portion when the first and second connectors are engaged to shield-connect the shield shells each other, wherein the connector housing of the first connector includes an outer housing provided outside the terminal container of the first connector;

wherein the shield shell of the first connector includes an inner shield shell which covers the terminal container of the first connector located at least between the terminal container and the outer housing, and an outer shield shell which contacts the inner shield shell and covers the outer housing;

wherein the inner shield shell encloses the terminal container, thereby shielding the metal terminal element accommodated by the terminal container; and wherein a second connecting portion is provided on one of the outer shield shell of the first connector and the shield shell of the second connector to couple to the other of the outer shield shell of the first connector and the shield shell of the second connector.

5. The shielded connector structure according to claim 4, wherein the second connecting portion is projected from one of the outer shield shell of the first connector and the shield shell of the second connector to the other, so that when the first and second connectors are engaged each other, the connecting portion is elastically deformed while contacting the other to generate an elastic restoring force for pressing the other.

6. The shielded connector structure according to claim 5, wherein a first through hole is formed through the outer housing of the first connector so that the second connecting portion is inserted into the first through hole.

7. The shielded connector structure according to claim 6, wherein the connector housing of the second connector includes an outer housing provided outside the terminal container of the second connector; and wherein a second through hole is formed through the outer housing of the second connector so that the second connecting portion is inserted into the second through hole.

8. The shielded connector structure according to claim 4, wherein the inner shield shell has a barrel portion fitted over the terminal container.

9. The shielded connector structure according to claim 4, wherein the metal terminal element of the first connector directly connects to the metal terminal element of the second connector.

10. The shielded connector structure according to claim 4, wherein the outer shield shell of the first connector contacts the connector mounting portion, thereby forming a first noise path for discharging noise blocked by the inner shield shell of the first connector from the connector mounting portion through the inner and outer shield shells of the first connector, the first noise path being different from a second noise path for discharging noise blocked by the shield shell of the second connector from the connector mounting portion through the second connecting portion and the outer shield shell of the first connector.

11. A shielded connector structure, comprising:

a first connector and a second connector, each including:

a metal terminal element;

an insulating connector housing that has a terminal container for accommodating the metal terminal elements, the terminal container comprising a main body and an interior; and a conductive shield shell which covers the terminal container of the connector housing;

a conductive connector mounting portion which contacts the shield shell of at least one of the first and second connectors to ground the shield shell;

a connecting portion which is provided on each of the shield shells of the first and second connectors, and is coupled to the connector mounting portion when the first and second connectors are engaged to shield-connect the shield shells each other; and a contact piece connecting the shield shells of the first and second connectors to each other when the first and second connectors are engaged, wherein the shield shell of the first connector comprises an inner shield shell located at least between the terminal container and the outer housing, and an outer shield shell which are connected to each other at a rear side of the first connector, and the connecting portion of the first shield shell is provided on the outer shield shell, thereby forming a first noise path for discharging noise blocked by the inner shield shell of the first connector from the connector mounting portion through the inner and outer shield shells and the connecting portion of the first connector, the first noise path being different from a second noise path for discharging noise blocked by the shield shell of the second connector from the connector mounting portion through the shield shell and the connecting portion of the second connector.

* * * * *